United States Patent [19]

Calabrigo

[11] Patent Number: 4,761,859

[45] Date of Patent: Aug. 9, 1988

[54] SKI BOOT ADJUSTMENT DEVICE

[75] Inventor: Giovanni B. Calabrigo, Treviso, Italy

[73] Assignee: Icaro Olivieri & C. S.p.A., Treviso, Italy

[21] Appl. No.: 945,972

[22] Filed: Dec. 24, 1986

[51] Int. Cl.[4] ..... A43B 5/04

[52] U.S. Cl. ..... 24/68 SK; 24/70 SK; 24/69 SK; 36/117

[58] Field of Search ..... 24/68 SK, 69 SK, 70 SK, 24/71 SK, 498; 36/117

[56] References Cited

U.S. PATENT DOCUMENTS

| | | | |
|---|---|---|---|
| 3,662,435 | 5/1972 | Allsop | 24/70 SK |
| 4,193,171 | 3/1980 | Lichowsky | 24/68 SK |
| 4,653,204 | 3/1987 | Morell et al. | 24/68 SK |
| 4,660,302 | 4/1987 | Arieh et al. | 36/117 |

FOREIGN PATENT DOCUMENTS

| | | | |
|---|---|---|---|
| 3013953 | 10/1981 | Fed. Rep. of Germany | 24/69 SK |
| 2577118 | 8/1986 | France | 36/117 |

*Primary Examiner*—Victor N. Sakran
*Attorney, Agent, or Firm*—Sughrue, Mion, Zinn, Macpeak and Seas

[57] ABSTRACT

The securement and adjustment device includes a base member having an elongated slot adapted to be secured to a ski boot. A pulley having a sawtooth wheel coaxially secured thereto is rotatably mounted within the elongated slot and is also mounted for movement lengthwise of the slot. At least one tensioning cable of the ski boot is adapted to be connected to the pulley. A slide member is slidably mounted on the base member for movement lengthwise of the slot. The slide member is provided with an elongated aperture in which the sawtooth wheel is received and is further provided with teeth adjacent one end of the aperture adapted to be moved into and out of engagement with the sawtooth wheel upon movement of the slide member relative to the wheel. A cover lever is pivotally mounted at one end to the base member for movement between a closed position overlying the base member and an open position. An operating lever is pivotally connected at one end to an intermediate portion of the cover lever and at the other end to the slide member whereby pivotal movement of the cover member will move the slide member and pulley member to one end of the slot to tighten the ski boot by means of the cable. Upon pivotal movement of the cover lever to the open position, the pulley can be moved to the other end of the slot to relieve the tension on the cable and upon further movement of the slide member, the sawtooth wheel will be free to rotate to adjust the tension on the cable.

3 Claims, 1 Drawing Sheet

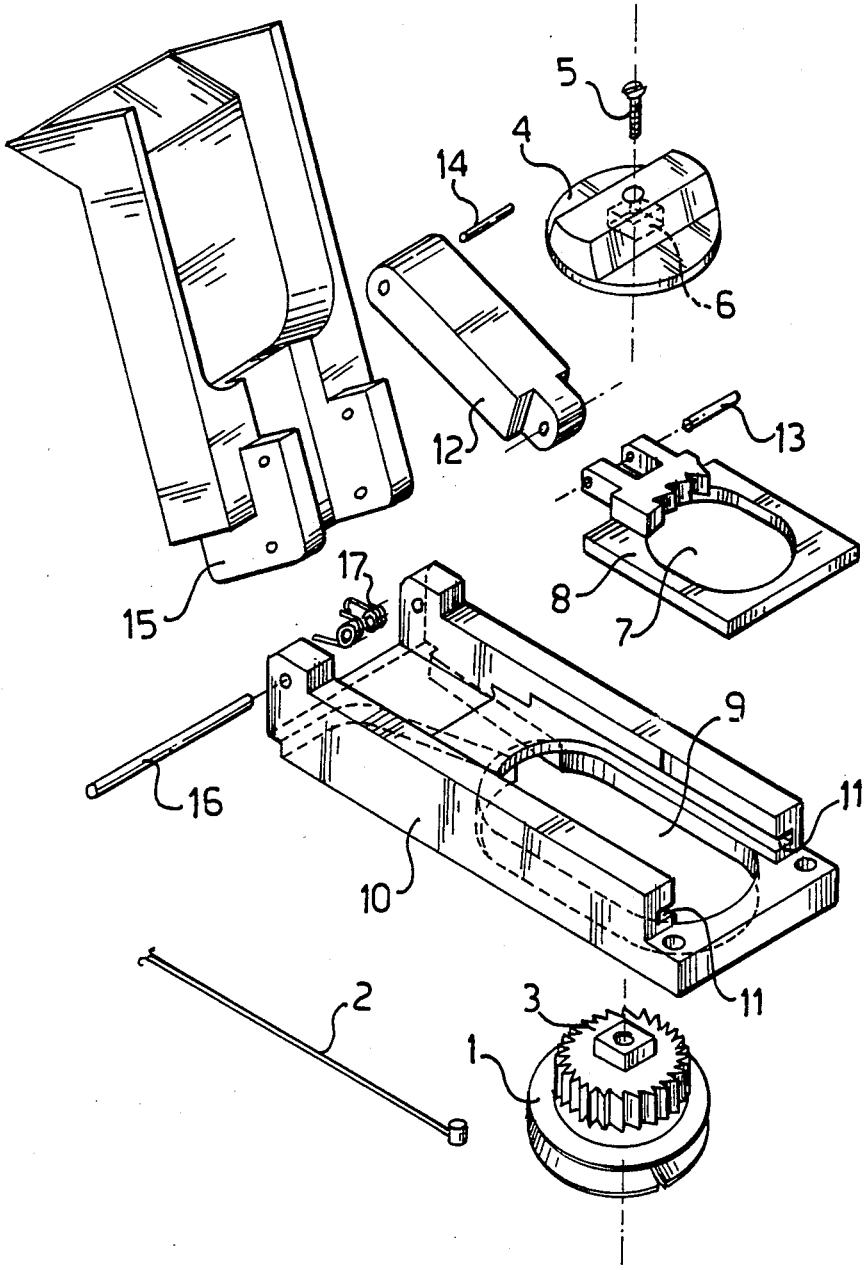
5
4
14
6
12
13
8
7
15
17
9
16
11
10
11
2
3
1

SKI BOOT ADJUSTMENT DEVICE

BACKGROUND OF THE INVENTION

The present invention relates to a device which enables parts or flaps of a ski boot to be adjusted and secured together by stretching small metal cables or strips.

There exist several types of closures, from the traditional levers to the more complicated closure systems by knob turning, with effort-reducing systems, but long stretching time.

SUMMARY OF THE INVENTION

The system according to the present invention has the advantage of providing very fast times for taking up the cables and hence bringing together the stretching flaps, with the final securing effort being provided by a traditional lever. The reverse operation of lever opening involves, where its rotation is carried to its extreme, automatic release of the cables and hence of the foot.

It has the advantage, over the traditional lever systems, of leaving no cables, strips, and levers hanging down and flapping against the boot when released.

Another object of the present mechanism is that it should be capable of giving full assurance of being reliable and safe to use on account of its intrinsic peculiarities.

The above functions, and the objects set forth, are achieved by a securement and adjustment device, particularly for ski boots according to the invention, characterized in that it comprises a pulley with small stretching cables or strips wound therearound and carries, rigidly and coaxially therewith, sawteeth and a grip point for its rotation and consequent taking taking up of the cables which will be wound in the groove of the pulley.

The pulley is accommodated on a suitable lever base and forced to travel by a slider with sawteeth formed thereon and being driven by the lever through a small arm joining the lever to the slide.

A spring located between the base and the lever, or between the pulley and the slide, will hold the pulley sawteeth in mesh engagement with those formed on the slide.

The pulley travel stroke length is limited by a slot or elevations formed on the base, the slide stroke length being limited by the lever-small joining arm system: the stroke length of the pulley on the base is slightly shorter than that of the slide, thereby the teeth formed on the slide can disengage from the teeth formed on the pulley on turning the lever to bring it to its open limit.

The boot part or flap stretching operation is being effected with a first open lever step of cable take-up and boot flap or part bringing together by rotation of the pulley grip point, and a second final stretching step by translation of the slide and hence the pulley and related cables with closure of the lever which provides the stretching effort.

The reverse operation of lever opening brings about backward translation of the slide and hence the pulley and hence first release of the small cables and if rotation of the lever is carried to its extreme one will also achieve release of the slide sawteeth from those of the pulley with full release of the small cables and the boot parts anchored thereon.

Thus, we have accomplished stretching and adjustment, securement and release of small cables and strips which are anchored on flaps or parts of a ski boot, in a simple and quick manner and with limited effort.

It is also possible to apply this same principle of adjustment, stretching, release, by positioning the travel slide on the opposed side from that indicated, or that with the lever in the closed position, the pulley and slide are no longer beneath the lever but rather on the opposite side relatively to the lever fulcrum.

It is also possible to apply this same principle of adjustment, securement, and stretching, no longer by pivoting the lever end on the base but rather on the slide and pivoting the small joining arms on the middle portion of the lever and the lever baser.

BRIEF DESCRIPTION OF THE DRAWINGS

Further features and advantages will become apparent from the detailed description of a securement and adjustment device for ski boots, shown in the accompanying drawing of FIG. 1 where all the component parts of the device may be seen in an exploded perspective view.

DETAILED DESCRIPTION OF THE INVENTION

With reference to FIG. 1 one can see the device according to the invention which is comprised of the pulley 1 with the sawteeth formed thereon and around whose groove the small cable(s) 2 or boot flap or part control strips are wound, or pressure surfaces and the elevation 3 enables coupling to the knob or grip point 4 through the screw 5 and the complementary notch 6 of the elevation.

The pulley 1 is accommodated inside the slot 7 formed on the travel slide 8 and inside the slot 9 of the base of the lever 10.

The travel slide 8 is driven by the small lever-joining arm 12 being joined through the pin 13 to the slide and the pin 14 to the lever 15; the lever 15 is joined through the pin 16 to the base of the lever 10. The spring 17, coaxial with the pin 16 and acting between the base and the lever, holds the lever, and hence the slide sawteeth, at all times in abutment relationship with those on the pulley.

It may be seen that with the lever 15 open we have moved the slide 8 and hence the pulley and hence released the small cables 2; the cables may also be released for full rotation of the lever and translation of the slide to its stroke limit overcoming the bias of the spring 17 thus disengaging the slide teeth from those on the pulley. For taking up, the knob 4 will be turned in the direction allowed by the sawteeth to the desired point and forced stretching will be then effected by closing the lever.

What is claimed is:

1. A securement and adjustment device for ski boots comprising a base member adapted to be secured to a ski boot and having an elongated slot therein, a pulley adapted to have at least one ski boot tightening cable connected thereto mounted in said slot for rotation and for movement lengthwise of the slot, a sawtooth wheel fixed coaxially with said pulley on one side thereof and extending above said slot, manually operable means secured to said wheel for rotating said wheel and pulley to adjust the tension of said cable, a slide member slidably mounted on said base member for movement lengthwise of said slot, said slide member having an elongated aperture in which said sawtooth wheel is received and having teeth adjacent one end of said aperture adapted to be moved into and out of engagement with said wheel upon movement of said slide member relative to said wheel, a cover lever pivoted at one end thereof to one end of said base member for pivotal movement into a closed position overlying said base member and an open position, an operating lever pivotably mounted at one end thereof to an intermediate portion of said cover lever and at the other end thereof to said slide member, whereby upon pivotal movement of said cover lever into the closed position, the slide member will move said pulley to one end of said slot with the teeth on said slide member engaging the teeth on said wheel to tighten the boot about the foot of the wearer and to prevent rotation of said pulley and upon movement of said cover lever into the open position, said teeth on said slide member will be moved out of engagement with said sawtooth wheel to permit rotation of said pulley for adjustment of the cable.

2. A securement and adjustment device as set forth in claim 1, further comprising spring means mounted between said base member and said cover lever for normally biasing said cover lever into the closed position.

3. A securement and adjustment device as set forth in claim 1, wherein the length of travel of said pulley in said slot is shorter than the length of travel of said slide member on said base member whereby upon movement of said cover lever to the open position, said teeth on said slide member will remain in engagement with said sawtooth wheel during the initial movement of said cover lever and will be separated from said sawtooth wheel during continued movement of said cover lever to the open position when said pulley reaches the end of said slot.

* * * * *